United States Patent [19]

Wendt et al.

[11] Patent Number: 4,664,304

[45] Date of Patent: May 12, 1987

[54] METERING MECHANISM FOR PAPER TOWEL DISPENSER CABINETS

[75] Inventors: David W. Wendt, Monona; Daniel R. Bullis, Jr., Madison; Alan F. Kemp, Janesville, all of Wis.; Gregory R. Suzda, Colorado Springs, Colo.

[73] Assignee: Mosinee Paper Corporation, Mosinee, Wis.

[21] Appl. No.: 752,999

[22] Filed: Jul. 8, 1985

[51] Int. Cl.[4] ..... B65H 20/02; B65H 23/18; B65H 75/02

[52] U.S. Cl. ..... 226/127; 242/55.2; 312/38

[58] Field of Search ..... 226/127, 129, 130, 131, 226/133, 161; 242/55.2, 55.3, 55.53, 58; 312/37, 38, 39, 215

[56] References Cited

U.S. PATENT DOCUMENTS 3,010,338 11/1961 Layton ..... 242/55.53 X

*Primary Examiner*—Stuart S. Levy
*Assistant Examiner*—Lynn M. Sohacki

[57] ABSTRACT

A metering mechanism for a paper towel dispenser cabinet is disclosed. The metering mechanism includes a metering gear which is rotatably driven by an operating mechanism of the dispenser cabinet. The metering gear has an axially extending cam portion which defines a radial cam surface extending continuously around the axis of the metering gear from a larger radius to a smaller radius and an abutment wall adjacent to the larger radius end of the cam portion. The metering gear also has an integral resilient finger adjacent to the abutment wall which is biased out of the plane of the metering gear. A release means is urged toward the axis of the metering gear and engages the abutment wall in a stopped position to inhibit rotation of the metering gear and thereby inhibit operation of the dispenser. The metering gear is released for rotation by moving the release means past the abutment wall until the spring finger snaps out of the plane of the metering gear to hold the release means clear of the abutment wall in a dispensing position ready to follow the cam surface. As the metering gear is rotated, the release means follows the cam surface from the larger radius to the smaller radius and eventually returns to the stopped position to once again stop the operation of the dispenser.

7 Claims, 13 Drawing Figures

METERING MECHANISM FOR PAPER TOWEL DISPENSER CABINETS

TECHNICAL FIELD

This invention relates to the art of paper towel dispenser cabinets and in particular to metering mechanisms for paper towel dispenser cabinets.

BACKGROUND OF THE INVENTION

Paper towel dispenser cabinets are well known. They can be found in many public lavatories where they hang on walls to dispense paper towel for users to dry their hands.

Prior art dispenser cabinets usually have either a crank or a lever which the user operates to dispense towel. With these dispensers, a user simply turns a crank or operates a lever until the desired length of towel is dispensed.

However, the prior art has recognized that allowing a user unbridled discretion as to the amount of paper towel dispensed can result in waste. To help eliminate such waste and conserve paper, some prior art dispensers are provided with a metering mechanism which provides an impediment to continuous dispensing. The metering mechanism usually requires the user to do some act such as press a button or wait for a period of time after a normally adequate length of paper towel has been dispensed to continue dispensing. The metering mechanism therefore provides an impediment to dispensing excessive amounts of towel.

SUMMARY OF THE INVENTION

The present invention provides a paper towel dispenser cabinet including an operating mechanism for dispensing paper towel stored in the cabinet and a metering mechanism for enabling a metered length of paper towel to be dispensed upon each actuation of the operating mechanism. A metering mechanism constructed in accordance with the invention includes a metering gear which is driven by the operating mechanism. The metering gear has a cam portion which defines a radial cam surface extending continuously around the axis of the metering gear in a first angular direction from a larger radius end to a smaller radius end. The cam portion also defines an abutment wall and the metering gear has a resilient finger biased out of the plane of the metering gear adjacent to the abutment wall. A release means is biased toward the axis of the metering gear to engage the abutment wall to inhibit rotation of the metering gear and therefore operation of the dispenser. The metering gear is released for rotation by moving the release means past the abutment wall so that the spring finger snaps out of the plane of the metering gear to hold the release means clear of the abutment wall. As the metering gear is rotated, the release means follows the cam surface from the larger radius end to the smaller radius end and eventually engages the abutment wall to once again stop the operation of the dispenser.

A metering mechanism of the invention employs a minimum number of parts and is easy to assemble. The various parts of the metering mechanism are suitable to be molded from plastic materials which make them easy and inexpensive to manufacture. The metering mechanism is also adaptable to different operating mechanisms, and can be used with either a crank or a lever mode operating mechanism.

DETAILED DESCRIPTION OF THE DRAWINGS

The present invention is described below, as required by 35 U.S.C. §112, in such full detail as to enable those skilled in the art to practice the invention and also to set forth the presently-contemplated best modes for its practice, all by reference to the following drawings in which:

FIG. 7 is a sectional view taken along line 7—7 of FIG. 6 and showing the connection between the drive pinion and the drive roll;

FIG. 13 is a perspective view from the left rear side of a cover for the mechanism module of FIG. 4.

DETAILED DESCRIPTION OF THE PREFERRED EMBODIMENT

Figure 1:
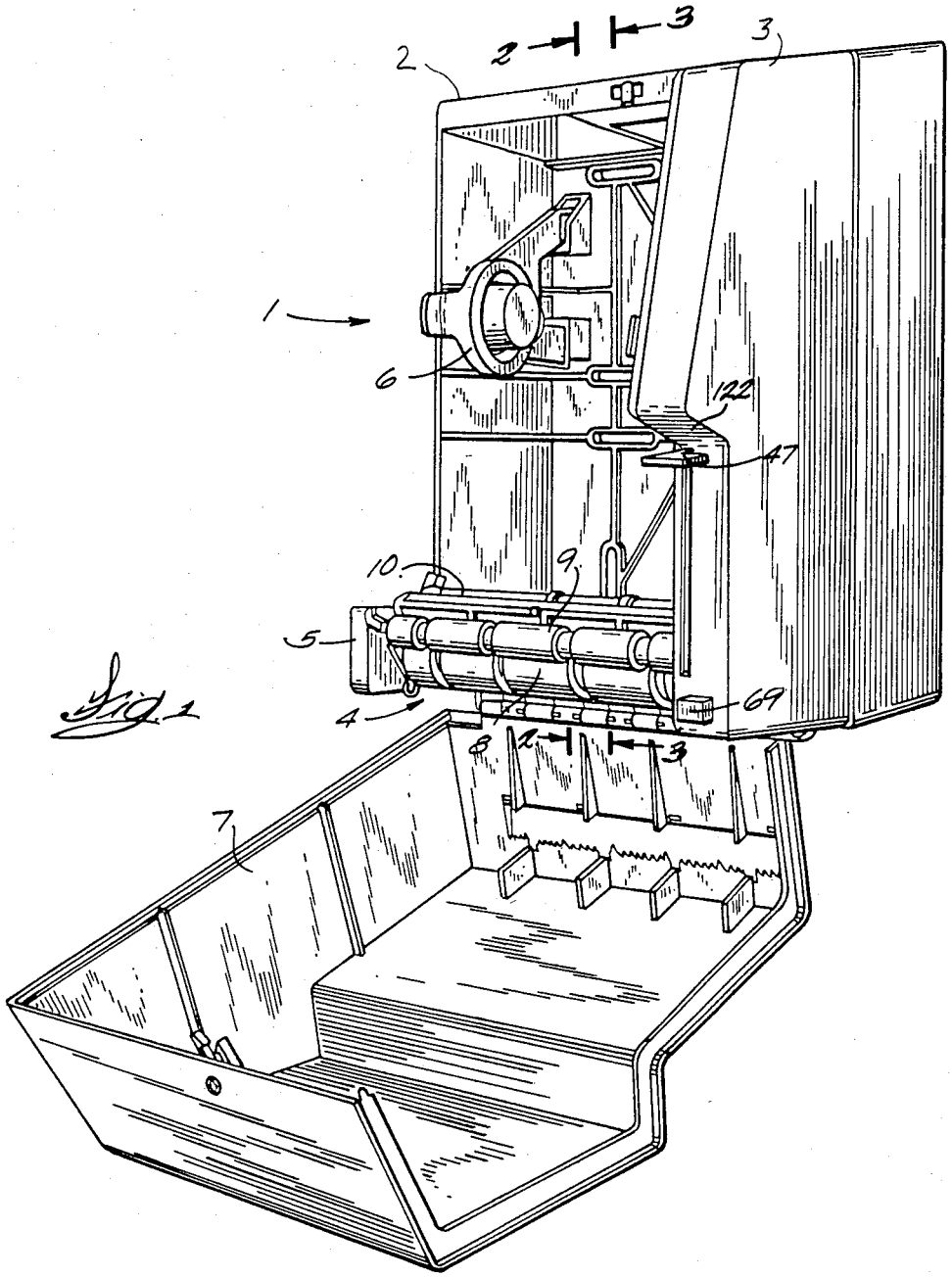
FIG. 1 is a perspective view of a paper towel dispenser cabinet which includes a metering mechanism constructed in accordance with the invention and is shown with the door open.
Figure 1:
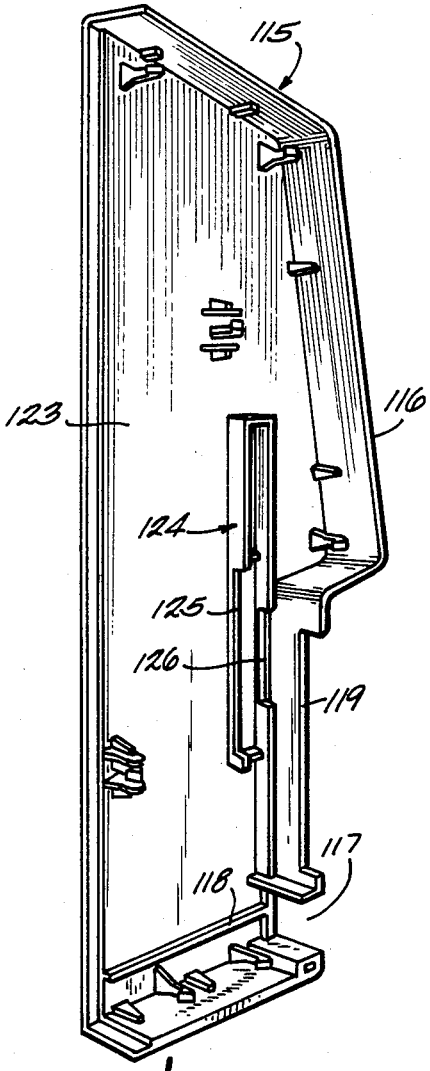
Figure 2:
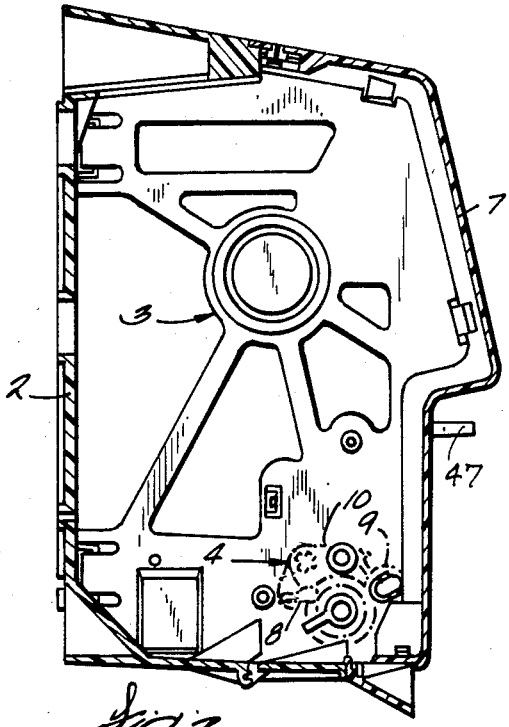
FIG. 2 is a sectional view taken along the plane of line 2—2 of FIG. 1 but with the door of the dispenser cabinet closed.
Figure 3:
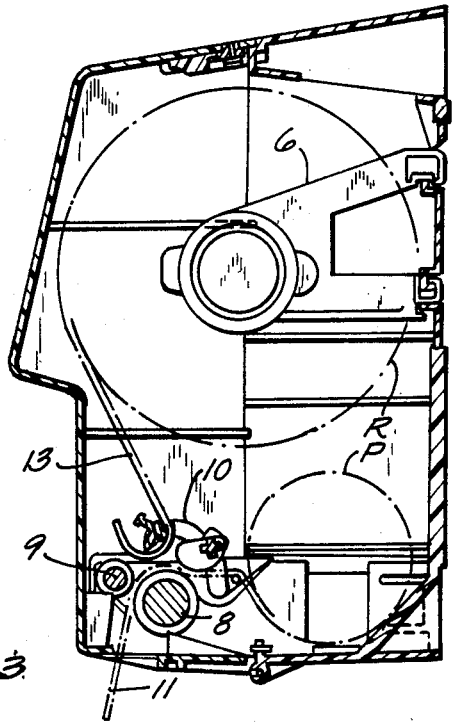
FIG. 3 is a sectional view taken along the plane of line 3—3 of FIG. 1 but with the door of the dispenser cabinet closed.

FIGS. 1–3 show a complete assembled dispenser cabinet 1 which includes a metering mechanism of the present invention. The dispenser cabinet 1 includes a back 2, a mechanism module 3, a delivery mechanism 4, a feed roll support arm 5, a reserve roll support arm 6 and a lockable door 7. The mechanism module 3 houses the operating mechanism and the metering mechanism and is attached to the back 2 to form the right front side of the dispenser cabinet 1. The delivery mechanism 4 includes a drive roll 8, an idler roll 9 and a transfer bar 10 and spans between the mechanism module 3 and the feed roll support arm 5 which is mounted to the back opposite the mechanism module. The reserve roll support arm 6 is assembled to the back 2 above the support arm 5 and the door 7 is hingedly connected to the back to complete the dispenser cabinet 1. While a metering mechanism of the present invention can be incorporated in many different types of dispenser cabinets, a full description of the cabinet 1 is given in the U.S. patent application entitled "Modular Paper Towel Dispenser" which was filed on July 1, 1985 now U.S. Pat. No. 4,611,768 and is hereby incorporated by reference.

In service, the back 2 is secured to a wall (not shown). Referring to FIG. 3, a web 11 of paper towel from a primary roll P supported in the bottom of the back is threaded between the drive roll 8 and the transfer bar 10, and into the nip between the drive and idler rolls 8 and 9, respectively, to be frictionally engaged by the drive roll 8. A web 13 of paper towel from a reserve roll R which is supported at one end by the reserve roll support arm 6 and at its other end by the mechanism module 3 is threaded through the transfer bar 10 and up over the idler roll 9. When a user operates the operating mechanism of the mechanism module 3, the drive roll 8 is rotationally driven to dispense a length of the web 11 from the primary roll P. When the primary roll P is exhausted and the end of its web passes by the transfer bar 10, the transfer bar urges the reserve roll web 13 into the nip between the drive and idler rolls to be dispensed. The details of operation of the delivery mechanism are not essential to a metering mechanism of the present invention but are more particularly described in Hedge et al. U.S. Pat. No. 4,165,138, issued Aug. 21, 1979, the disclosure of which is hereby incorporated by reference.

Figure 4:
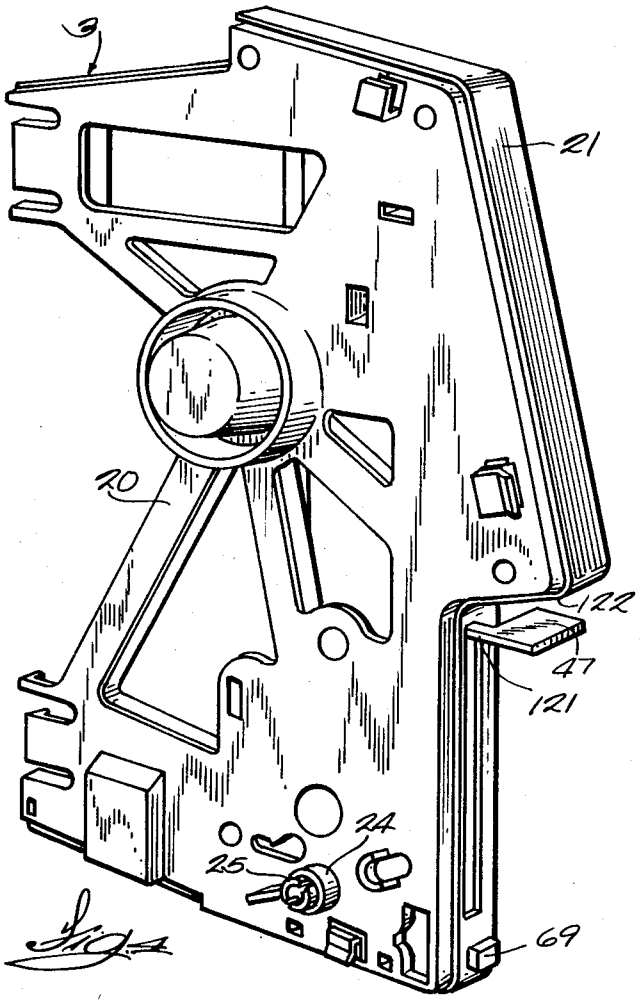
FIG. 4 is a perspective view of a mechanism module for the dispenser of FIG. 1 as viewed from the left front side.
Figure 4:
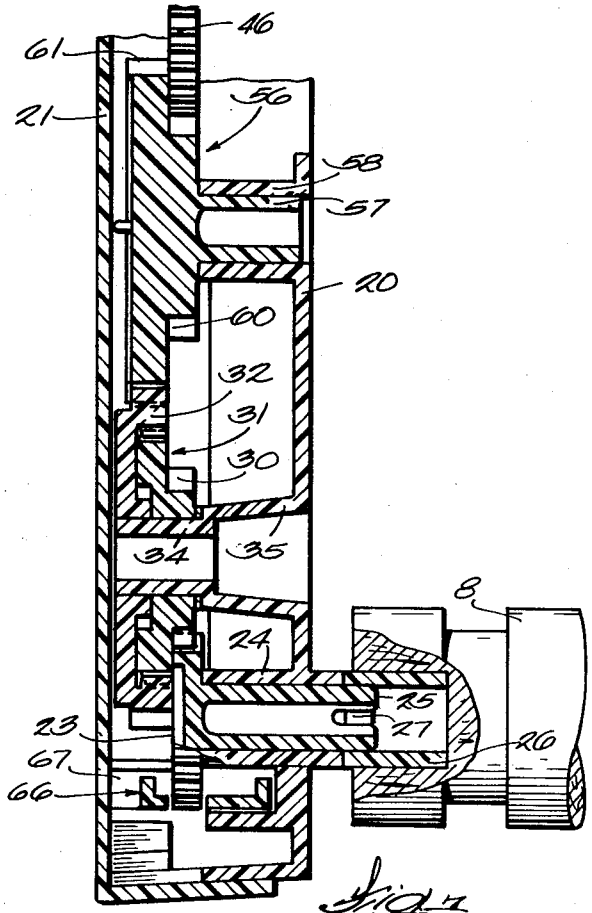

In the preferred embodiment, the mechanism module 3 houses the operating and metering mechanisms and is shown by itself in FIG. 4. It comprises a mechanism plate 20 (FIG. 5) to which all of the components of the operating and metering mechanisms are mounted. It also includes a cover 21 which is mounted to the mechanism plate to hold the various components in place and which is part of the exterior of the dispenser cabinet. The mechanism plate, the cover and all of the components of the operating and metering mechanisms except a few springs are preferably molded from plastic materials. Suitable plastic resins include ABS resins, acetal resins, nylon resins, urethane resins, and high impact polystyrene resins.

Figure 6:
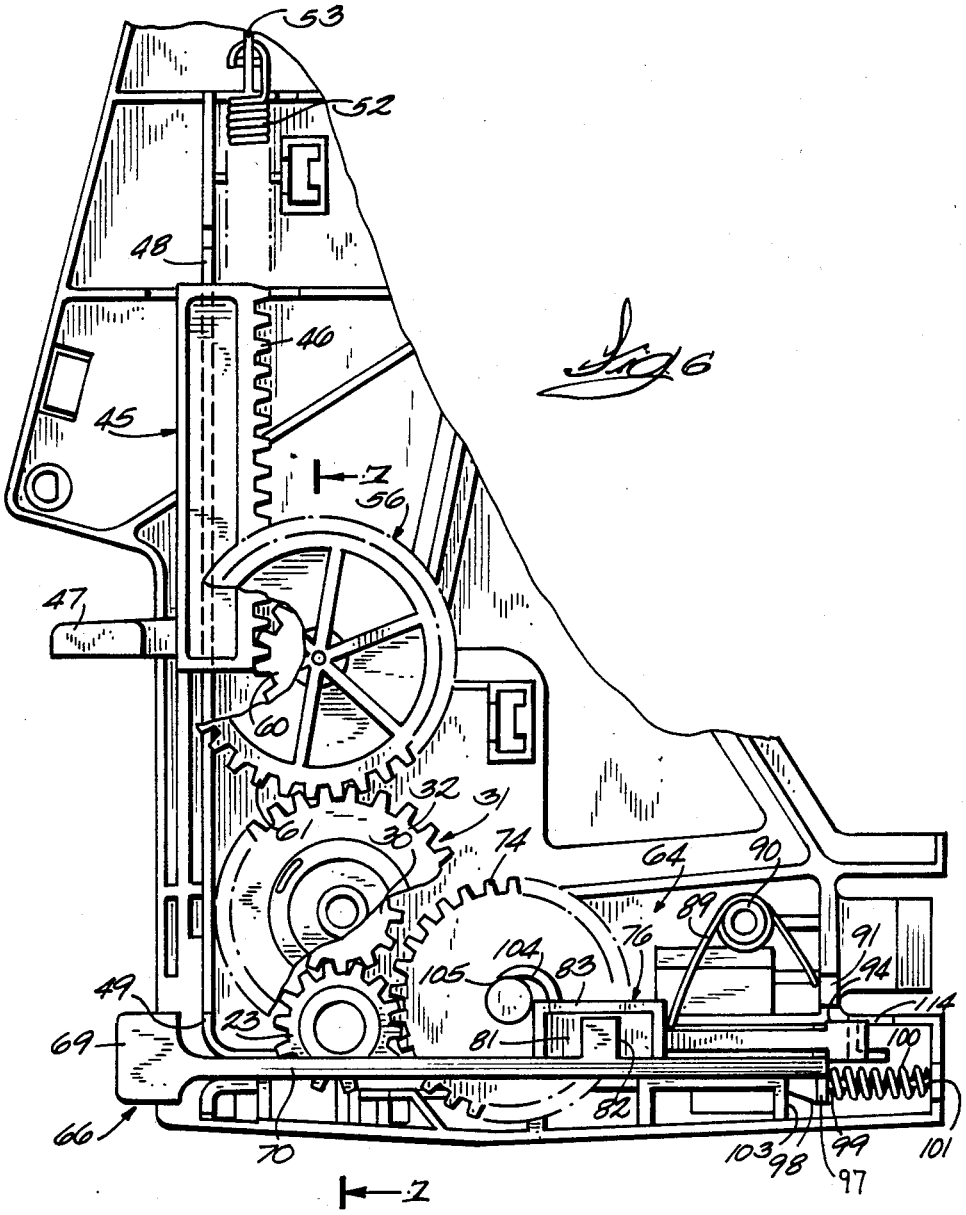
FIG. 6 is a fragmentary view with portions broken away of a metering mechanism constructed in accordance with the invention for the mechanism module of FIG. 4 and shown incorporated with a lever mode operating mechanism.

The operating mechanism rotatably drives the drive roll 8 to dispense the paper towel. Referring to FIGS. 6 and 7, a drive pinion 23 having an integral shaft is journaled in a sleeve 24 which is integral with the mechanism plate 20 and is strengthened by reinforcing ribs. The sleeve 24 extends a short distance from the drive roll side of the mechanism plate 20 and the end 25 of the drive pinion shaft extends beyond the end of the sleeve (FIGS. 4 and 7). The end 25 of the drive pinion shaft is forked to rotationally engage the end of the drive roll 8. A sleeve 26 is mounted in the end of the drive roll 8 which has an integral diametral web 27 which fits between the forks of the drive pinion shaft (FIG. 7).

The drive pinion 23 meshes with a clutch gear 30 of an overrunning clutch 31 which also includes a drive gear 32. The overrunning clutch 31 is rotationally mounted on a stub sleeve 34 projecting from a larger diameter sleeve 35 which is integral with the mechanism plate 20 and which is strengthened by reinforcing ribs.

The overrunning clutch 31 insures that the drive pinion 23 will be driven in only the counter-clockwise direction as viewed in FIG. 6 so that the drive roll 8 cannot be rotated backwardly by the operating mechanism. Therefore, when the drive gear 32 is rotated clockwise as viewed in FIG. 6, the clutch gear 30 is positively connected to the drive gear 32 and rotates with the drive gear in the clockwise direction. If the drive gear 32 is rotated counter-clockwise, the clutch gear 30 is not drivingly engaged with the drive gear 32 and the drive gear rotates relative to the clutch gear. The friction of the delivery mechanism 4 is sufficient to hold the clutch gear 30 stationary as the drive gear 32 rotates counter-clockwise relative to it. A more detailed description of two specific embodiments of the overrunning clutch 31 is given in the copending U. S. patent application, "Modular Paper Towel Dispenser," referred to above.

Figure 5:
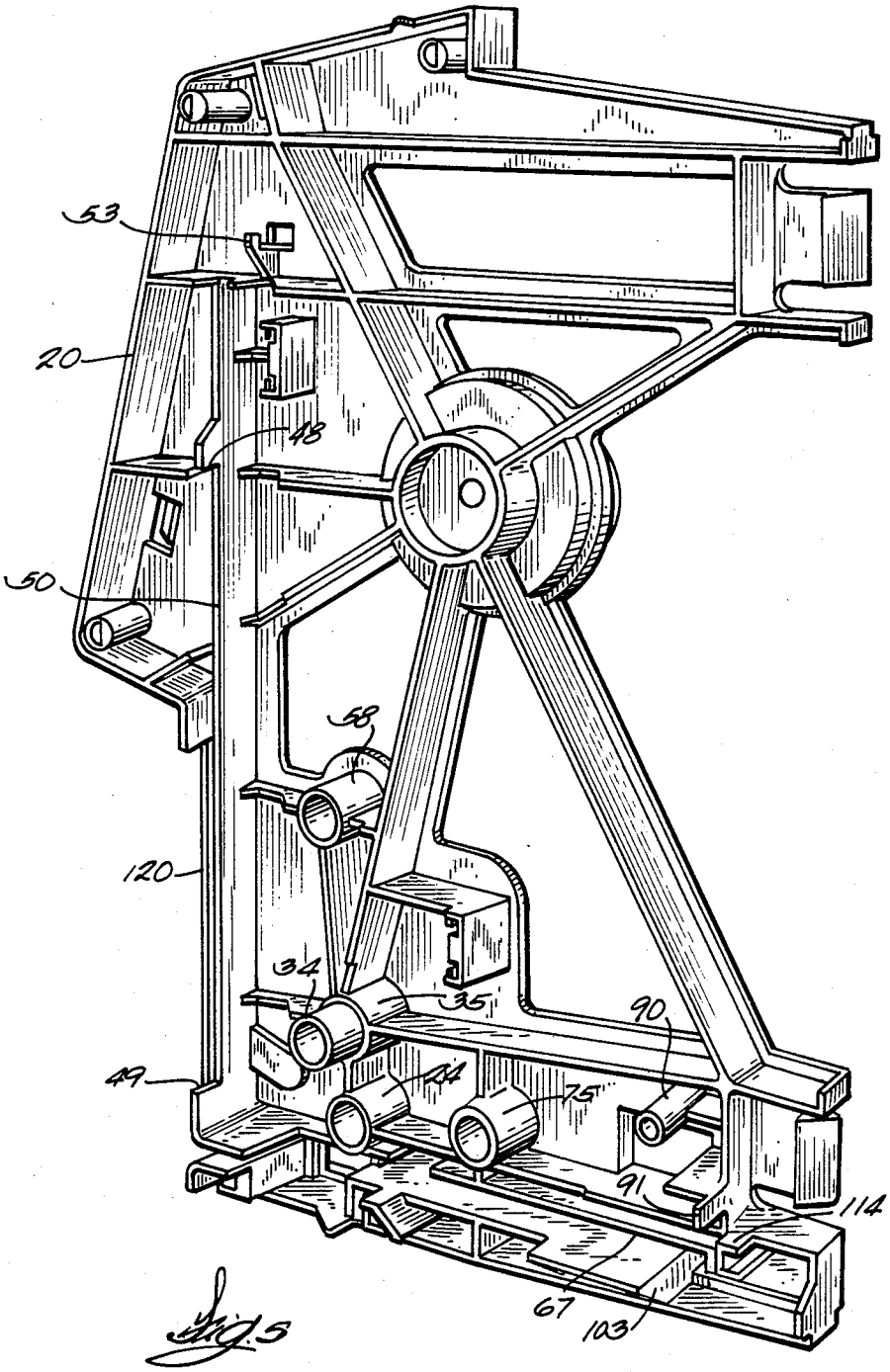
FIG. 5 is a perspective view of a mechanism plate for the mechanism module of FIG. 4 as viewed from the right rear side.

A lever actuator 45 which is reciprocable in a vertical plane is provided to drive the drive gear 32. The lever actuator 45 has an integral rack 46 having gear teeth and a handle 47 which is operable by a user. The lever actuator 45 is slidably mounted for vertical translatory motion between an upper stop 48 and a lower stop 49 of a slide bar 50 which is molded into the mechanism plate 20 and is best shown in FIG. 5. An extension spring 52 is connected between the lever actuator 45 and a finger 53 of the mechanism plate 20 to bias the lever actuator upwardly.

A rack gear 56 couples the lever actuator 45 to the overrunning clutch 31. Referring to FIGS. 6 and 7, the rack gear 56 has an integral shaft 57 which is journaled in a rib reinforced sleeve 58 of the mechanism plate 20. A rack pinion 60 is formed integrally with the shaft 57 along one end thereof and meshes with the rack 46 of the lever actuator 45. The rack pinion 60 is integral with a rack drive gear 61 which meshes with the drive gear 32 of the overrunning clutch 31.

In operation, as the lever actuator 45 is moved downwardly, it drives the rack gear 56 counter-clockwise as viewed in FIG. 6. The rack gear 56 drives the drive gear 32 of the overrunning clutch 31 clockwise so that it is fixedly coupled to the clutch gear 30 which therefore also rotates clockwise. This rotates the drive pinion 23 counter-clockwise to drive the drive roll 4 to dispense a length of paper towel. On the upward, return stroke of the lever actuator 45, the rack gear 62 is rotated clockwise and the drive gear 32 is rotated counter-clockwise. When driven in this direction, the drive gear 32 overruns the clutch gear 30, which remains stationary due to friction in the drive system. The lever actuator 45 thereby returns to the top of its stroke without driving the drive roll 4 backwardly.

A metering mechanism 64 of the present invention is also illustrated in FIG. 6. The metering mechanism 64 requires the user to press a button before operating the lever actuator 45 to dispense a length of paper towel. Even then, only a limited number of successive reciprocations of the lever actuator 45 is allowed before the button must be reset to continue dispensing. One pressing of the button allows a length of paper towel to be dispensed which is adequate for the normal person to dry his or her hands. Any more dispensed paper towel usually would only result in waste. The metered feature therefore introduces an impediment against excessive dispensing to deter waste of paper towel.

Figure 8:
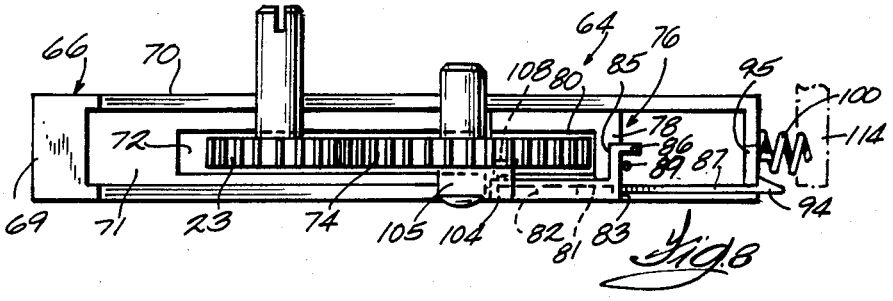
FIG. 8 is a top view of the metering mechanism of FIG. 6 shown together with the drive pinion.
Figure 9:
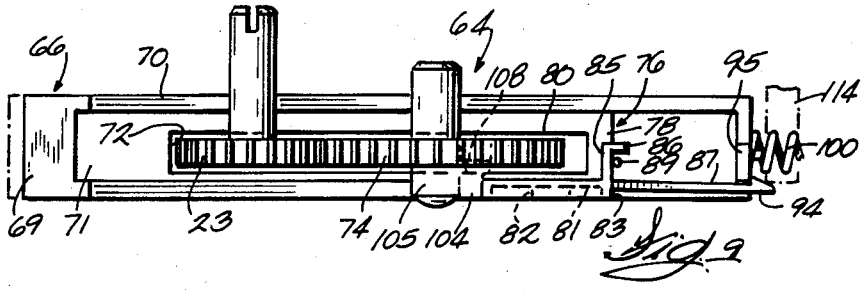
FIG. 9 is a view similar to FIG. 8 but shown with the metering mechanism in a depressed position.
Figure 10:
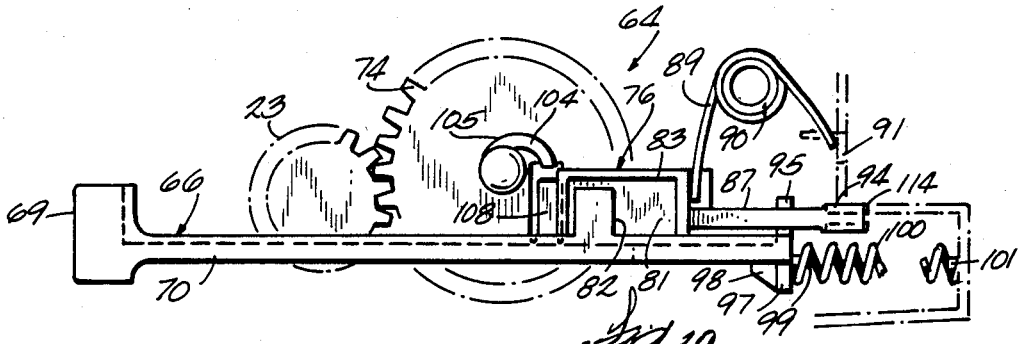
FIG. 10 is a side view of the metering mechanism of FIGS. 6, 8 and 9 shown in a dispensing position.

For clarity, FIGS. 8–10 show only the drive pinion 23 together with the components of the metering mechanism 64. Means operable by a user are provided in the metering mechanism 64 by a metering release element 66 which is slidably disposed in a channel 67 (FIG. 5) of the mechanism plate 20. The metering release element 66 includes a button 69 at the front and a rectangular body 70 which extends rearwardly from the button. As best shown in FIGS. 8 and 9, the interior 71 of the body is recessed and includes a slot 72 in which the lower portions of the drive pinion 23 and a metering gear 74 are disposed. The drive pinion 23 is journaled in the mechanism plate 20 as previously described and the metering gear 74 is journaled in a rib reinforced sleeve 75 (FIGS. 5 and 12) of the mechanism plate 20. The slot 72 is wide enough to allow the drive pinion 23 and the metering gear 74 to rotate freely and long enough to avoid interference with the gears in all positions of operation.

A release means 76 is slidably received in the interior 71 of the body 70 near the rear of the slot 72. The release means 76 has a base 78 which extends across the width of the recessed interior 71 and has a forwardly opening slot 80 which is aligned with the slot 72 and in which the metering gear 74 is disposed and can rotate freely. A stop wall 81 extends upwardly along the outside edge of the base 78 adjacent to the side surface of the metering gear 74 and is restrained against outward movement by a support tab 82 which extends upwardly from the edge of the metering release element 66 and abuts the stop wall 81. The sides of a raised rim 83 on the stop wall 81 provide outer limits for the sliding motion of the release means 76 relative to the metering release element 66.

The rear portion of the stop wall 81 and the raised rim 83 are integral with a rear wall 85 which projects upwardly from the rear of the base 78. A tab 86 and a cantilever spring catch 87 project rearwardly from the rear wall 85 to define a space between them on the rear wall in which one end of a torsion spring 89 which is mounted on a sleeve 90 (FIGS. 5, 6 and 10) of the mechanism plate 20 is disposed. The other end of the torsion spring 89 presses against a wall 91 of the mechanism plate so that the torsion spring 89 biases the release means 76 toward the axis of the metering gear. The spring catch 87 has a ramped end 94 which, as shown in FIGS. 8 and 9, defines a forwardly facing shoulder which is normally engaged behind an upstanding tab 95 which extends upwardly from the rear edge of the metering release element 66.

A rear wall 97 extends downwardly from the rear edge of the metering release element 66, is reinforced by a fillet 98, and has a stub 99 on its rear surface. The stub 99 captivates one end of a compression spring 100 which has its other end captivated by a stub 101 (FIGS. 6 and 10) on the mechanism plate 20. The forward edge of the rear wall reinforcing fillet 98 abuts an edge 103 of the mechanism plate 20 to limit the forward movement of the metering release element 66.

Figure 11:
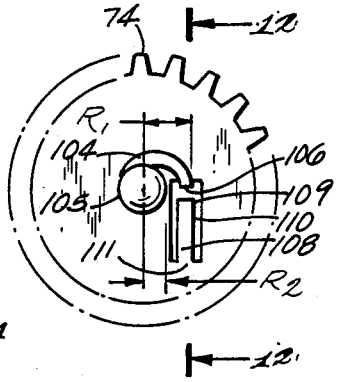
FIG. 11 is a detail view of a metering gear for the metering mechanism of FIGS. 6 and 8–10.
Figure 12:
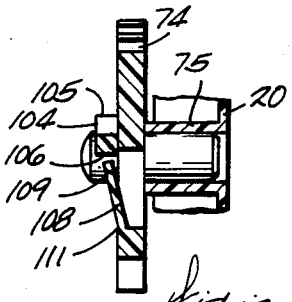
FIG. 12 is a sectional view taken along the plane of line 12—12 of FIG. 11 and showing the mounting of the metering gear in the mechanism plate.

Referring to FIGS. 11 and 12, the metering gear 74 has a cam portion 104 which is integral with and extends axially from the side surface of the metering gear. The radially outward surface of the cam portion 104 defines a cam surface 105 which extends around the axis of the metering gear 74 from a larger radius end of radius $R_1$ to a smaller radius end of radius $R_2$ in the counter-clockwise direction (FIG. 11). The cam portion 104 defines an abutment wall 106 adjacent to the larger radious end of the cam surface 105.

The side surface of the metering gear 74 also has an integral resilient finger 108. A free end 109 of the resilient finger 108 is disposed adjacent to the abutment wall 106 of the cam portion. The resilient finger 108 is biased outward from the plane of the side of the metering gear and the outer edge 110 of the resilient finger 108 is substantially aligned with the larger radius end of the cam surface 105. The resilient finger 108 extends from the free end 109 to a connected end 111 in the plane of the metering gear 74 in the clockwise direction and is resilient in a plane perpendicular to the plane of the metering gear so that it can be pressed toward the plane of the side of the metering gear.

To dispense a length of paper towel, a user must first depress or reset the button 69 to move the metering release element 66 and the release means 76 backwardly against the forward biasing forces of the springs 89 and 100. When the button 69 is depressed about as far as shown in FIG. 9, the stop wall 81 of the release means 76 is moved past the resilient finger 108 so that the resilient finger 108 snaps outwardly. When the button 74 is pushed a little further rearwardly than shown in FIG. 9, the forwardly facing shoulder of the ramped end 94 of the spring catch 87 is released from being caught behind the upstanding tab 95 by a projection 114 of the mechanism plate 20 and the release means 76 is urged forwardly against the outer edge 110 of the resilient finger 108 by the torsion spring 89 as shown in FIG. 10. The projection 114 also serves as a stop which the tab 95 abuts to limit the rearward movement of the metering release element 66. When the button 69 is released, the spring 100 urges the metering release element 66 forwardly to its normal position, also as shown in FIG. 10.

In the dispensing position of the release means 76 shown in FIG. 10, the metering gear 74 and therefore the drive pinion 23 are free to rotate to dispense a length of paper towel. The drive pinion 23 rotates counter-clockwise as the user pushes the lever actuator 45 downwardly. The metering gear therefore rotates clockwise on the downward stroke of the lever actuator 45. Reverse rotation of the drive pinion 23 and of the metering gear 74 on the upward stroke of the lever actuator 45 is prevented by the overrunning clutch 31. As the metering gear 74 is rotated clockwise, the forward surface of the stop wall 81 rides onto the cam surface 105 and the release means 76 follows the cam surface 105 of the cam portion 104. The inside surface of the stop wall 81 engages the outside surface of the connected end 111 of the resilient finger 108 in about the last quarter of rotation of the metering gear 74 and begins to press the resilient finger 108 back into the plane of the metering gear 74. After one full revolution of the metering gear, the resilient finger 108 is pressed into the plane of the side of the metering gear and the abutment wall 106 of the cam portion 104 engages the top of the stop wall 81 so that the metering gear 74 and the drive pinion 23 are stopped in their rotation. Thereby, the metering assembly is returned to the stopped position of FIGS. 6 and 8. If the user desires more sheet material, he must press the button 69 again to reset the metering assembly to the dispensing position before reciprocating the lever actuator 45.

The relative sizes of the drive roll 4, the drive pinion 23 and the metering gear 74 are such that one revolution of the metering gear 74 is sufficient to dispense a length of paper towel which is adequate for the normal user. While the projection 114 prevents the user from holding the release stop 76 backwardly and therefore prevents unmetered operation, the user can always dispense more paper towel by repeatedly depressing the button and dispensing. However, this procedure discourages wasteful use of paper towel.

A molded plastic cover 115 shown in FIG. 13 is secured to the mechanism plate 20 to hold the components of the operating and metering mechanisms in place. It can be secured to the mechanism plate by snap locking connectors which are fully described in the patent application entitled "Modular Paper Towel Dispenser", previously referred to, or by any other appropriate means.

The front wall 116 of the cover 115 is provided with a rectangular cut-out 117 which is aligned with the pushbutton 69 when the cover is assembled to the mechanism plate 20. The periphery of the cut-out 117 is reinforced and the button 69 protrudes from the front wall 116. A rib 118 is also provided which is aligned with the side edge of the metering release element 66 to hold the front portion of the metering release element in the channel 67. Note that it is also desirable to provide a similar rib in the back 2 as an extension of the rib 118 to hold the rear portion of the metering release element 66 in the channel 67 when the mechanism module is assembled to the back.

To accommodate the lever actuator 45 and the handle 47, the front wall 116 of the cover 115 has an elongated cut-away 119 which is opposite from a similar cut-away 120 (FIG. 5) in the mechanism plate 20. These cut-aways are sized to receive a neck 121 (FIG. 4) of the handle 47. It is also noteworthy that the handle 47 is positioned below a lip 122 of the mechanism module to protect it against violent blows by the user.

A side wall 123 of the cover 115 abuts the gears of the operating mechanism when it is assembled to the mechanism plate 20 to hold the gears in place. A raised rib structure 124 is provided on the inside of the sidewall 123 to bear against the side of the lever actuator 45 to hold it in place as it is reciprocated. The rib structure 124 is cut-out as shown at 125 and 126 to allow clearance for the rack drive gear 61.

A metering mechanism for a lever mode operating mechanism has now been fully described. Note however that the metering mechanism of the invention could also be used with a crank mode operating mechanism as fully described in the "Modular Paper Towel Dispenser" patent application, previously referred to.

A metering mechanism of the invention is mainly comprised of parts which are especially suited to be molded from plastic materials. The component parts are few and are easy to assemble. Therefore, the invention provides a metering mechanism which is inexpensive to make and versatile in its applications.

Numerous variations and modifications to the preferred embodiment will be apparent to those skilled in the art which will result in operating mechanisms which embody the invention. Therefore, it is not intended that the invention be defined by the preferred embodiment or the foregoing description thereof, but only by the claims which follow, except as otherwise required by law.

We claim:

1. A paper towel dispenser cabinet including an operating mechanism for dispensing paper towel stored in the cabinet and a metering mechanism for enabling a metered length of paper towel to be dispensed upon each actuation of the operating mechanism, said metering mechanism comprising, in combination:

(1) a metering gear in meshing engagement with the operating mechanism and including (a) a cam portion integral with and extending axially from a first side surface of the metering gear, the cam portion defining a radial cam surface which extends continuously around the axis of the metering gear in a first angular direction from a larger radius end to a smaller radius end and defining an abutment wall adjacent to the larger radius end of the cam surface; and (b) a resilient finger integral with the metering gear and biased outwardly of the plane of the first side of the metering gear, the resilient finger including an outer edge substantially aligned with the larger radius end of the cam surface adjacent to the abutment wall;

(2) release means adjacent to the first side surface of the metering gear and movable relative to the metering gear between (a) a stopped position in which the release means presses the resilient finger toward the plane of the first side surface of the metering gear and abuts the abutment wall to stop rotation of the metering gear in a second angular direction opposite to the first direction; and (b) a dispensing position in which the resilient finger is in its outwardly biased position and the release means is in engagement with the outer edge of the resilient finger to hold the release means in position to follow the cam surface;

(3) means operable by a user for moving the release means to its dispensing position; and (4) biasing means for urging the release means toward the axis of the metering gear to cause the release means to follow the cam surface to the stopped position of the release means as the metering gear is rotated in the second angular direction, wherein the release means presses the resilient finger toward the plane of the first side surface of the metering gear as the release means follows the cam surface to the stopped position.

2. A paper towel dispenser cabinet as in claim 1, wherein the resilient finger comprises:

a free end adjacent to the abutment wall which is biased outwardly from the plane of the first side of the metering gear and includes the outer edge substantially aligned with the larger radius end of the cam surface; and a connected end integral with the metering gear in the plane of the first side surface of the metering gear positioned a distance in the second angular direction from the free end.

3. A paper towel dispenser cabinet as in claim 1, further comprising:

a cantilever spring catch integral with the release means to engage the means operable by a user in the stopped position of the release means; and means for releasing the cantilever spring catch from the means operable by a user as the release means is moved past its dispensing position.

4. A paper towel dispenser cabinet as in claim 1, wherein the release means includes a stop wall adjacent to the first side surface of the metering gear with a top surface which engages the abutment wall in the stopped position of the release means and a side surface which engages the outer edge of the resilient finger in the dispensing position of the release means.

5. A paper towel dispenser cabinet as in claim 1, wherein the means operable by a user comprises a metering release element including a button operable by a user and a body to which is slidably mounted the release means.

6. A paper towel dispenser cabinet as in claim 1, wherein the biasing means comprises a torsion spring in engagement with the release means to urge the release means toward the axis of the metering gear.

7. A paper towel dispenser cabinet as in claim 1, 2, 3, 4, 5 or 6, wherein the metering gear, the release means and the means operable by a user are made of plastic materials.

* * * * *